US005749311A

United States Patent [19]

Kobayashi et al.

[11] Patent Number: 5,749,311

[45] Date of Patent: May 12, 1998

[54] PRESSER FOOT DEVICE FOR SEWING MACHINE

[75] Inventors: Hideyuki Kobayashi; Koichi Toda, both of Utsunomiya, Japan

[73] Assignee: The Singer Company N.V., Curaco, Netherlands Antilles

[21] Appl. No.: 693,812

[22] Filed: Aug. 1, 1996

[51] Int. Cl.[6] ..... D05B 29/00

[52] U.S. Cl. ..... 112/240

[58] Field of Search ..... 112/240, 235, 112/60, 61

[56] References Cited

U.S. PATENT DOCUMENTS

| | | | |
|---|---|---|---|
| 2,919,668 | 1/1960 | Adam et al. | 112/235 |
| 3,145,674 | 8/1964 | Kurihara | 112/240 |
| 3,800,720 | 4/1974 | Niino | 112/235 |
| 3,973,508 | 8/1976 | Eguchi et al. | 112/240 |
| 4,643,116 | 2/1987 | Ulmer et al. | 112/240 |

*Primary Examiner*—Peter Nerbun

*Attorney, Agent, or Firm*—McCormick, Paulding & Huber

[57] ABSTRACT

A presser foot device comprises a presser foot shank [2] which has clamp member through holes [2*d*] for guiding clamp members in moving forward and backward formed at the lower portion thereof and a groove for receiving the hinge pin [3*b*] of a presser foot plate [3] formed on the lower surface of the front side thereof and a groove [2*a*] for receiving the hinge pin [3*b*] of a presser foot plate [3] therein formed on the lower surface of the front side thereof, and which is detachably attached to a presser bar [5,] an elastic [9] member which is fixed to the rear portion of the presser foot shank [2] at one end portion thereof, and the clamp members [7] each having a hook portion [7*a*] for retaining the hinge pin [3*b*] of the presser foot plate [3] at the tip end portion thereof, wherein the hinge pin [3*b*] of the presser foot plate [3] is elastically clamped by the hook portions [7*a*] of the clamp members [7] and the rear wall [2*c*] of the groove [2*a*]. As a result, it is possible to provide a presser foot device simple in structure, superior in reliability with regard to the essential function of a presser foot plate, and superior in durability.

2 Claims, 2 Drawing Sheets

PRESSER FOOT DEVICE FOR SEWING MACHINE

BACKGROUND OF THE INVENTION

1. Field of the Invention

The present invention relates to a presser foot device for a sewing machine, the presser foot device being capable of exchanging a presser foot plate therein for an arbitrary one meeting a sewing condition in one-shot operation.

2. Description of the Related Art

There are known various kinds of presser foot devices in which one of various different presser foot plates can be detachably attached to a presser foot shank. A conventional presser foot device of this kind, for example, is disclosed in Japanese Utility Model No. 60-16376. In the presser foot device, a wire is inserted into a through hole at the lower end portion of the presser foot shank at the tip end portion thereof to be freely slidable therein, and the hinge pin of the presser foot plate is inserted into an engaging groove formed on the lower surface of the presser foot shank. The wire is moved forward or backward under the hinge pin received in the engaging groove by operating a lever portion swingably attached to the presser foot shank to project or contract the tip end portion thereof onto or out of the engaging groove. Accordingly, it is possible to detachably attach one of various different presser foot plates to the presser foot shank.

Such a conventional presser foot device for sewing machine, however, has a structure in which the hinge pin of the presser foot plate is closely brought into contact with the upper surface of the engaging groove at the upper end portion thereof and is supported by the upper surface of the tip end portion of the wire at the lower surface thereof, so that the hinge pin and consequently the presser foot plate cannot be firmly supported so that it is liable to become loose in support during sewing operation. As a result, there is a technical problem that the presser foot plate is inferior in reliability with regard to its essential function and also in durability in spite of its complicated structure.

Another conventional presser foot device for sewing machine of this kind is also known as that disclosed in Japanese Utility Model No. 55-46138. This presser foot device employs a system in which various kinds of presser foot plates are attached to the lower end of a presser bar in a turret. That is, the presser foot device comprises a rotating body, which has a plurality of presser foot plates and is supported to be rotatable about an axis relative to the presser bar and a retaining means for retaining the rotating body at a plurality of positions, wherein one of the presser foot plates is positioned under the presser bar corresponding to the sewing portion of the sewing machine while other presser foot plates are positioned above a cloth ahead of the presser foot plate in the cloth feeding direction of the sewing machine when the rotating body is retained at any of the positions. According to this system, being different from the conventional detachably attaching system set forth above, it is possible to mount a plurality of presser foot plates meeting different sewing conditions on the presser foot device and perform a sewing operation by selectively using a presser foot plate.

In the conventional presser foot device, however, since several kinds of presser foot plates are attached to the rotating body, the presser foot device is increased in inertial mass, so that it becomes difficult that the presser foot plate certainly follows the vertical movement of a feed dog that rapidly comes in and out on a throat plate. As a result, it has a technical problem that it is inferior in durability in the presser foot plate and the portion of the rotating body attached to the presser bar as well as in the essential function of the presser foot plate in spite of its complicated structure. Particularly when it is applied to an industrial sewing machine which is operated at high speed, the inertial mass of the presser bar is increased as a whole, so that a stable cloth feeding cannot be expected. Moreover, other presser foot plates attached to the lower end portion of the presser bar adjacent to working place to be used for other processes obstructs the sewing operation, thereby reducing the efficiency thereof.

As described above, conventional presser foot devices for sewing machines having exchangeable presser foot plates are mainly designed for household use, and there seems to be no presser foot device which certainly functions with durability and simple structure in an high-speed industrial sewing machine.

SUMMARY OF THE INVENTION

The present invention has been made in view of such a technical problem of prior art to provide a presser foot device having the following structure.

A presser foot device according to a first aspect of the invention comprises a presser foot shank 2 which has clamp member through holes **2*d* for guiding clamp members 7 in moving forward and backward formed at the lower portion thereof and a groove 2*a* for receiving the hinge pin 3*b* of a presser foot plate 3 therein formed on the lower surface of the front side thereof, and which is detachably attached to a presser bar 5, an elastic member 9 which is fixed to the presser foot shank 2 at one end portion thereof, and the clamp members 7 each having a hook portion 7*a* for retaining the hinge pin 3*b* of the presser foot plate 3 at the tip end portion thereof, wherein the hinge pin 3*b* of the presser foot plate 3 is elastically clamped by the hook portions 7*a* of the clamp members 7 and the rear wall 2*f* of the groove 2*a***.

A presser foot device according to a second aspect of the invention is that of the first aspect of the invention, wherein a clamp member mount 8 is fixed to the elastic member 9 and the base end portions of the clamp members 7 are detachably fixed to the clamp member mount 8.

According to the first aspect of the invention, the presser bar 5 is raised and the elastic member 9 is pushed by a finger from the rear side thereof to move the clamp members 7 forward against the resilience of the elastic member 9. As a result, the clamp members 7 are pushed forward being guided by the clamp member through holes **2*d* so that the hook portions 7*a* open the groove 2*a*. At this state, the hinge pin 3*b* of the presser foot plate 3 can be inserted into the groove 2*a***.

In case of mounting the presser foot plate 3 on the presser foot shank 2, when the elastic member 9 is released from being pressed while the hinge pin **3*b* is inserted into the groove 2*a*, the clamp members 7 return back to their original positions by the resilience of the elastic member 9. At that time, the hinge pin 3*b* received in the hook portions 7*a* is drawn back to be brought into contact with the rear wall 2*f* of the groove 2*a*. In this way, the hinge pin 3*b* of the presser foot plate 3 is elastically brought into close contact with the hook portions 7*a* at the front portion thereof and is elastically brought into contact with the rear wall 2*f* of the groove 2*a* at the rear surface thereof to be clamped by the hook portions 7*a* and the rear wall 2*f*, so that it is elastically supported by the presser foot shank 2**.

According to the second aspect of the invention, since the base end portions of the clamp members 7 are detachably attached to the clamp member mount 8 fixed to the elastic member 9, if the clamp members 7 are deformed in any chance, the clamp members 7 alone can easily be exchanged with new ones.

DESCRIPTION OF THE PREFERRED EMBODIMENT

The preferred embodiments of the present invention will be described hereinafter with reference to drawings.

Figure 1:
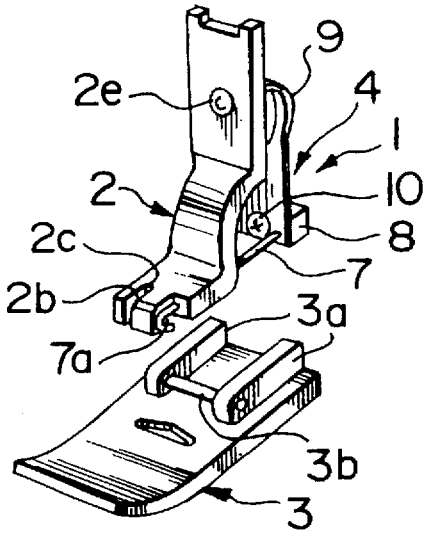
FIG. 1 is a partially cross-sectional perspective view of a presser foot device for a sewing machine according to an embodiment of the present invention.
Figure 2:
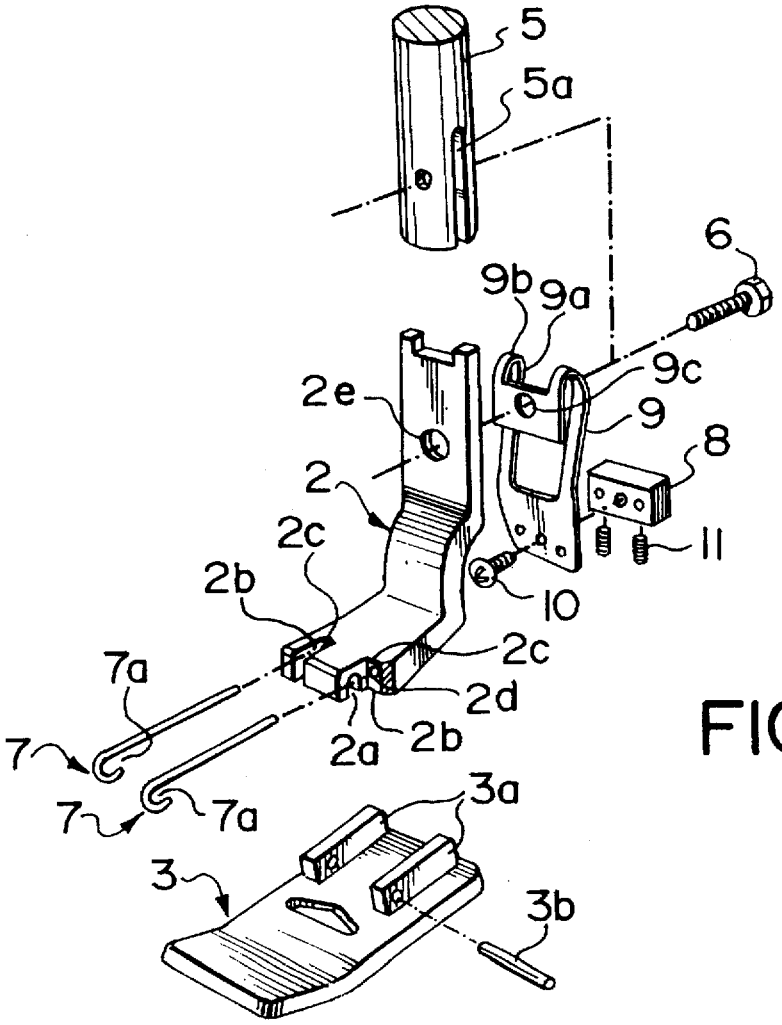
FIG. 2 is an exploded perspective view of the presser foot device in FIG. 1.
Figure 3:
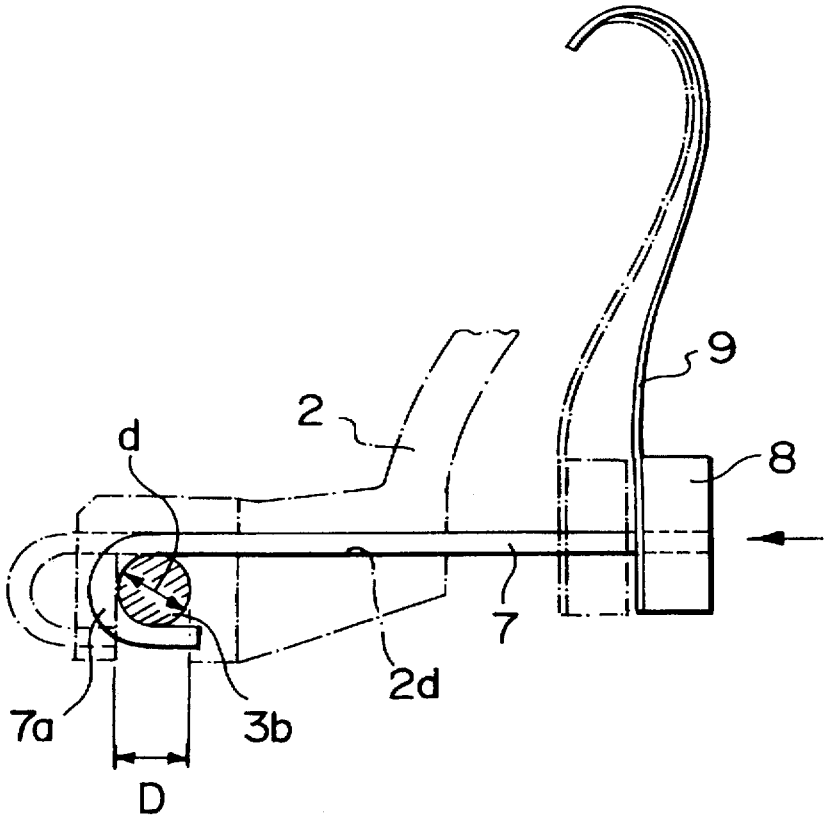
FIG. 3 is a view for explaining the operation of the presser foot device in FIG. 1.

FIGS. 1 to 3 show a presser foot device according to a first embodiment of the present invention. A presser foot device 1 is composed of a presser foot shank 2, a presser foot plate 3 and a presser foot plate holder 4. The presser foot plate holder 4 comprises clamp members 7, a clamp member mount 8 and an elastic member 9. The presser foot plate 3 comprises a pair of supporting portions 3*a* projecting from the right and left side portions of the upper surface thereof to hold a hinge pin 3*b* therebetween by forcing the both end portions of the hinge pin 3*b* into the supporting portions 3*a* respectively to fix the former to the latter.

The presser foot shank 2 which is L-shaped comprises a presser foot mounting hole 2*e* at the upper end portion thereof and a groove 2*a* which has a width D and extends right and left on the lower surface of the front end thereof as illustrated in FIG. 3. The width D of the groove 2*a* is set a little larger than the diameter of the hinge pin 3*b* of the presser foot plate 3 so that the hinge pin 3*b* having an outer diameter d of the presser foot plate 3 can be freely inserted into the groove 2*a*. The presser foot shank 2 comprises narrow hook portion receiving grooves 2*b* formed at right and left side portions thereof by notching the same and clamp member through holes 2*d* which respectively extend from the rear wall 2*c* of each hook portion receiving groove 2*b* toward the rear side of the presser foot shank 2 piercing the lower portion thereof. Each of the clamp member through holes 2*d* is formed to cross the groove 2*a* at the extension thereof, each clamp member 7 being slidably inserted into each clamp member through hole 2*d*.

Each clamp member 7 which is made of metal wire to have a shape of a slender rod is bent downward at the tip end portion thereof to form a semi-circular hook portion 7*a*. The base end portion of each clamp member 7 is inserted into each clamp member through hole 2*d* from the side of the hook portion receiving groove 2*b* thereof and further into each hole of the clamp member mount 8 to be detachably fixed therein by each clamp member attaching screw 11. The clamp member mount 8 is fixed to the lower end portion of the elastic member 9 by a screw 10. Each clamp member 7 can move in each hook portion receiving groove 2*b* forward and backward to project and contract the hook portion 7*a* thereof. Moreover, since the clamp members 7 are made of metal wires, they are strong to secure durability.

The elastic member 9 formed by bending a flat spring in a shape of J, the flat spring being made of spring steel and comprising an opening 9*a* formed at the central portion thereof, comprises a presser foot mounting hole 9*c* formed at an upper end portion thereof and the clamp member mount 8 which is previously attached to the lower end portion thereof. The elastic member 9 has a function of always elastically urging each clamp member 7 backward. Moreover, since the elastic member 9 is made of spring steel, it is strong to secure durability.

Such a presser foot device 1 can be detachably attached to the presser bar 5 by inserting the upper end portion of the presser foot shank 2 and the one end portion of the elastic member 9 superposed on each other into a mounting groove 5*a* formed at the lower end portion of the presser bar 5 and screwing a screw 6 into the presser bar 5 through the presser foot mounting hole 9*c* of the elastic member 9 and the presser foot mounting hole 2*e* of the presser foot shank 2. When the presser foot shank 2 and elastic member 9 are attached to the presser bar 5, the lower end portion of the presser bar 5 is located in the opening 9*a* formed at the upper end portion of the elastic member 9, so that the elastic member 9 does not interfere with the presser bar 5 at the portion adjacent to the upper end thereof and consequently does not obstruct the lower end portion of the elastic member 9 in forward or backward elastic deformation.

The function of the above embodiment will be described hereinafter.

The presser foot plate 3 is attached to or detached from the presser foot shank 2 as follows. When the presser foot plate 3 is attached to the presser foot shank 2, the presser bar 5 is raised to operate the presser foot plate holder 4. That is, the clamp member mount 8 is pushed from behind by a finger to move the clamp member mount 8 toward the front side as far as a position indicated by a dotted line in FIG. 3 against the resilience of the elastic member 9. As a result, since the clamp members 7 are pushed forward being guided by the clamp member through holes 2*d* so that the hook portions 7*a* open space under the groove 2*a*, the hinge pin 3*b* of the presser foot plate 3 is inserted into the groove 2*a*.

Successively, when the clamp member mount 8 is released from being pressed, the resilience of the elastic member 9 returns the clamp member mount 8 and each clamp member 7 backward. At that time, the hinge pin 3*b* received in the hook portions 7*a* is pulled backward to be brought into contact with the rear wall 2*f* of the groove 2*a*. In this way, the hinge pin 3*b* of the presser foot plate 3 is elastically brought into close contact with the hook portions 7*a* each having a semi-circular shape at the front half portion thereof and is elastically brought into contact with the rear wall 2*f* of the groove 2*a* at the rear surface thereof to be clamped by the hook portions 7*a* and the groove 2*a* so that the hinge pin 3*b* is elastically supported by the presser foot shank 2.

On the other hand, when the presser foot plate 3 is detached from the presser foot shank 2, the presser bar 5 is raised and the presser foot plate holder 4 is operated similarly. That is, the clamp member mount 8 is pushed toward the front side from behind by a finger against the resilience of the elastic member 9 to move the hook portions 7*a* so as to open space under the groove 2*a*. At this state, the hinge pin 3*b* of the presser foot plate 3 is detached from the groove 2*a*. In this way, it is possible to attach or detach one of various kinds of presser foot plates 3 meeting a sewing condition to or from the presser foot shank 2 in one-shot operation.

Although a pair of clamp members 7 are provided in the embodiment set forth above, a single or more than two clamp members 7 can also obtain a function similar to that of the above embodiment. Moreover, the hook portions 7*a* are formed to be semi-circular by bending the tip end portions of the clamp members 7 in the above embodiment, it is enough for the hook portions 7*a* to be capable of retaining the hinge pin 3*b* so as to prevent the same from dropping out of the hook portion receiving grooves 2*b*, so that it is also possible to bend the tip end portions of the clamp members 7 in various kinds of hook shapes. Although the groove 2*a* of the presser foot shank 2 is formed at the lower surface thereof in the above embodiment, it is enough for the groove 2*a* to receive the hinge pin 3*b* therein and bring the same in contact with the rear wall 2*f* thereof, so that it is also possible to let the groove 2*a* open forward. Moreover, it is also possible to provide a compressed coil spring about each clamp member 7 between the rear surface of the presser foot shank 2 and the elastic member 9 to help the elastic member 9 in elastically urging the clamp members 7 backward.

As understood from the above description, the present invention has the following effects.

(1) Since the hinge pin of the presser foot plate is elastically clamped in the groove of the presser foot shank by a clamp member elastically urged backward by the resilience thereof, the return of the elastic member is effectively used for holding the hinge pin. As a result, the presser foot plate is firmly attached to the presser foot shank, so that it hardly becomes loose and is superior in durability.

(2) Since the presser foot device is formed by only adding the elastic member and a clamp member having a simple shape to the presser foot shank, it is light and can perform stable cloth feeding without any trouble even in high-speed sewing operation.

(3) Since the presser foot device is simple in structure, low in cost and easy in manufacturing, the present invention is applicable not only to an industrial sewing machine but also to a household sewing machine.

What is claimed is:

1. A presser foot device comprising:

at least two clamp members;

a presser foot plate;

a hinge pin releasably coupled to said presser foot plate;

a presser foot shank having an upper portion, and a lower portion defining at least two through holes for slidably receiving and guiding said clamp members for movement in a forward and backward direction, said lower portion having a front surface defining a groove for receiving said hinge pin;

an elastic member coupled to said upper portion of said presser foot shank and adapted to receive and urge said clamp members in said backward direction;

said clamp members each having a tip defining a hook portion for retaining said hinge pin of said presser foot plate; and wherein said hinge pin is engageable with said hook portions and is biased against a rear wall of said groove by said elastic member.

2. A presser foot device as defined by claim 1 wherein:

said clamp members include base end portions; and a clamp member mount is coupled to said elastic member and is adapted to releasably receive said base end portions of said clamp members.

* * * * *